US011090971B1

(12) United States Patent
Yerry

(10) Patent No.: US 11,090,971 B1
(45) Date of Patent: Aug. 17, 2021

(54) PEN CAP / LOW LIGHT ADJUSTMENT TOOL FOR LASER AIMING DEVICES

(71) Applicant: Charles Yerry, Fayetteville, NC (US)

(72) Inventor: Charles Yerry, Fayetteville, NC (US)

( * ) Notice: Subject to any disclaimer, the term of this patent is extended or adjusted under 35 U.S.C. 154(b) by 0 days.

(21) Appl. No.: 17/090,686

(22) Filed: Nov. 5, 2020

(51) Int. Cl.

| | |
|---|---|
| ***B43K 29/18*** | (2006.01) |
| ***B25F 1/00*** | (2006.01) |
| ***B43K 29/10*** | (2006.01) |
| ***F21V 33/00*** | (2006.01) |
| ***B25B 23/18*** | (2006.01) |
| *F21Y 115/10* | (2016.01) |

(52) U.S. Cl.
CPC ..... *B43K 29/10* (2013.01); *B25B 23/18* (2013.01); *F21V 33/0048* (2013.01); *F21Y 2115/10* (2016.08)

(58) Field of Classification Search
CPC ..... B25B 23/18; B43K 29/10; F21V 33/0048
See application file for complete search history.

(56) References Cited

U.S. PATENT DOCUMENTS

| | | | | |
|---|---|---|---|---|
| 6,036,332 | A | 3/2000 | Antal | |
| 6,874,188 | B2 * | 4/2005 | Johnson | B26B 5/001 7/158 |
| 7,066,673 | B1 * | 6/2006 | Kuo | B43K 27/08 401/11 |
| 7,086,797 | B1 * | 8/2006 | Huang | B43K 7/005 362/118 |
| 7,237,340 | B2 * | 7/2007 | Johnson | B26B 11/008 30/162 |
| D662,116 | S | 6/2012 | Harden et al. | |
| 8,191,192 | B1 * | 6/2012 | Barker | B43K 27/08 7/160 |
| 8,368,318 | B2 | 2/2013 | Kuster | |
| 9,315,067 | B2 * | 4/2016 | Chauvin, II | B43K 24/06 |
| 9,427,861 | B2 | 8/2016 | Reynolds | |
| 9,561,683 | B2 * | 2/2017 | O'Connor | B43K 29/08 |
| 9,943,947 | B2 | 4/2018 | Tseng | |
| D874,900 | S | 2/2020 | Prieto et al. | |
| 10,549,571 | B1 * | 2/2020 | Abel | A45C 11/24 |
| 10,926,575 | B2 * | 2/2021 | Gupta | B43L 23/06 |
| 2017/0028572 | A1 * | 2/2017 | Raymond | B26B 11/00 |

* cited by examiner

*Primary Examiner* — Arman B Fallahkhair
(74) *Attorney, Agent, or Firm* — Optima Law Group, APC

(57) ABSTRACT

The present invention teaches that a custom designed tool might serve as a marker cap for a standard size and diameter of marker such as a Sharpie® or Revmark® brand marker, along with an LED or low light LED or dim red LED or even infrared LED, and a hex drive socket which could then be used with an appropriate size of hex bit (such as a BITHEX™ tool head) for the exact size of adjustment screw heads found on any particular laser gun aiming device. The LED serves to light the laser aiming device screw head and the hex bit tool head, and in embodiments may be quite dim or otherwise inconspicuous.

9 Claims, 7 Drawing Sheets

PEN CAP / LOW LIGHT ADJUSTMENT TOOL FOR LASER AIMING DEVICES

CROSS-REFERENCE TO RELATED APPLICATIONS

N/A

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

FIELD OF THE INVENTION

This invention relates generally to pen & marker caps (not markers nor pens nor yet pen style flashlights), but specifically to pen & marker caps combined with a light and a hex drive tool for making fine adjustments on laser aiming devices such as are used by military personnel, tactical teams, law enforcement, and so forth.

STATEMENT REGARDING FEDERALLY FUNDED RESEARCH

This invention was not made under contract with an agency of the US Government, nor by any agency of the US Government.

BACKGROUND OF THE INVENTION

The laser aiming device requires fine adjustment before it can provide an accurate aim point for military personnel, tactical teams, and law enforcement. These fine adjustments are made using a number of small adjustment screws on the laser aiming device itself. FIG. 10 is a PRIOR ART drawing of a laser 1001 atop a gun, the fine screw heads are easily visible. This is a vastly over-simplified view of a laser aiming device somewhat similar to an ATPIAL by Eotech®. The visible/IR aiming device is most easily seen, the angle not conducive to showing the twin lasers, and with various controls such as the function/mode selector omitted, the IR illuminator cover omitted, the laser cover occluded on the backside, the power button removed and so forth. However, four elevation and windage adjustment screws 1003 are indicated: three are visible and one on the far side indicated with an arrow. Obviously other models exist and may be used with the present invention.

Making such delicate adjustments on these diminutive screws is quite easy on the calm confines of an enclosed workbench while not using the weapon. The inventor, a member of this group with 25 years of experience, noticed during actual weapon usage, for example, training in the field, that it is not normal to find personnel carrying their fine tip screwdrivers. In general, the inventor observed that fellow military personnel might find themselves needing to make different or better adjustments at an awkward time, when they were busy, already heavily burdened, and in possession of relatively few tools, and possibly in a hurry. The present invention will quickly save users hours of wasted time on gun ranges alone.

In efforts to adjust the tiny screw heads, service members and law enforcement end up holding weapons at odd angles while using the weapon-mounted flashlight, and may end up pointing the muzzle of the weapon at other personnel nearby. Service members end up using somewhat brighter lights (such as flashlights or weapon mounted lights) and thus reducing their night vision, yet another danger in some circumstances.

However, for diverse reasons such personnel frequently carry markers of the Sharpie® or Revmark® type. The present invention is not directed toward markers of any type.

On the range or during preparation, personnel zeroing their laser pointers frequently will have such markers on them. The present invention is directed toward such range use.

The present invention teaches that a custom designed tool might serve as a marker cap, an LED/low light LED/red LED/infrared LED, and a hex drive socket which could then be used with an appropriate size of hex bit (such as a BITHEX™ tool head) for the exact size of adjustment screw heads found on any particular laser aiming device. The LED serves to light the laser aiming device screw heads 1003 and the hex bit tool head, and in embodiments may be quite dim or otherwise inconspicuous.

On the other hand, the present invention is not directed toward markers of any type, but toward caps for markers, since the cap of the invention would in fact be used longer than a single marker and would be transferred from marker to marker as markers ran dry.

The present invention is not directed toward pen lights or other similar small flashlights, being distinguished from them by not only the fact that the present invention is a cap, not a flashlight, but also by having a hex drive socket, tool head, an inconspicuous light source, an aggressive grip section and more.

It would be preferable to provide a marker cap having a tool driver thereon.

It would further be preferable to provide a marker cap having an inconspicuous light source thereon.

It would yet further be preferable to provide a marker cap with an aggressive grip so that it may be removed from the shaft of the marker and used as a tool driver.

It would yet further be preferable to provide a marker cap with the potential for easy low-cost manufacturing, even manufacturing individually.

All of these objectives, aspects, advantages and embodiments are met by the following invention.

SUMMARY OF THE INVENTION

General Summary

The present invention teaches a custom designed tool of the socketed driver type which may be more or less "stored" in a user's pocket, bag, equipment, gear, or pack by serving as a marker cap for a standard size and diameter of marker such as a Sharpie® or Revmark® brand marker.

However, it may also have an LED or low light LED or dim red LED or even infrared LED, brighter types for use in less stressful situations and dimmer types when less light is desirable, which LED may illuminate a hex drive socket which could then be used with an appropriate size of hex bit (such as a BITHEX™ tool head). Notice that by providing a driver socket rather than a single fine tip screwdriver, an operator may personally select a tool tip to match the exact size of adjustment screw heads found on any particular laser aiming device.

Summary in Reference to Claims

It is therefore another aspect, advantage, objective and embodiment of the invention, in addition to those discussed previously, to provide a device for use on a standard diameter of marker, the device comprising:

a cap body having a pen tip cavity dimensioned and configured to frictionally engage to such standard diameter marker, the pen tip cavity airtight when engaged to such standard diameter marker whereby such marker does not dry;

the cap body having a first end having thereon a hex drive socket;

the cap body having an LED disposed at the hex drive socket;

the cap body having a battery therein;

the cap body having a switch, the switch having an on position and an off position;

the battery, the LED and the switch in electrical communication with one another, whereby when the switch is in the on position the LED provides illumination.

It is therefore another aspect, advantage, objective and embodiment of the invention, in addition to those discussed previously, to provide a device further comprising:

a knurled grip section on the cap body.

It is therefore another aspect, advantage, objective and embodiment of the invention, in addition to those discussed previously, to provide a device the hex drive socket further comprising:

a magnet disposed within the hex drive socket.

It is therefore another aspect, advantage, objective and embodiment of the invention, in addition to those discussed previously, to provide a device further comprising:

a hex bit dimensioned and configured to fit within the hex drive socket;

whereby when the hex bit is within the hex drive socket it is magnetically engaged thereto.

It is therefore another aspect, advantage, objective and embodiment of the invention, in addition to those discussed previously, to provide a device further comprising:

a flexible clip attached to the exterior of the cap body, the flexible clip urging itself against the exterior of the cap body.

It is therefore another aspect, advantage, objective and embodiment of the invention, in addition to those discussed previously, to provide a device further comprising:

a battery cover disposed over the battery, the battery and battery cover disposed between the clip and the cap body.

It is therefore another aspect, advantage, objective and embodiment of the invention, in addition to those discussed previously, to provide a device wherein the LED further comprises:

a red LED.

It is therefore another aspect, advantage, objective and embodiment of the invention, in addition to those discussed previously, to provide a device wherein the LED further comprises:

an LED with a light output of less than 5 lumens;

whereby it is more difficult to observe use of the LED and use of the LED will not reduce night vision.

It is therefore another aspect, advantage, objective and embodiment of the invention, in addition to those discussed previously, to provide a device wherein the hex drive socket comprises a transparent material; whereby the LED disposed in the hex drive socket may shine through the transparent material and shine past the hex bit.

It is therefore another aspect, advantage, objective and embodiment of the invention, in addition to those discussed previously, to provide a device wherein:

the LED is disposed at the hex drive socket and within it.

INDEX TO REFERENCE NUMERALS

Figure 1:
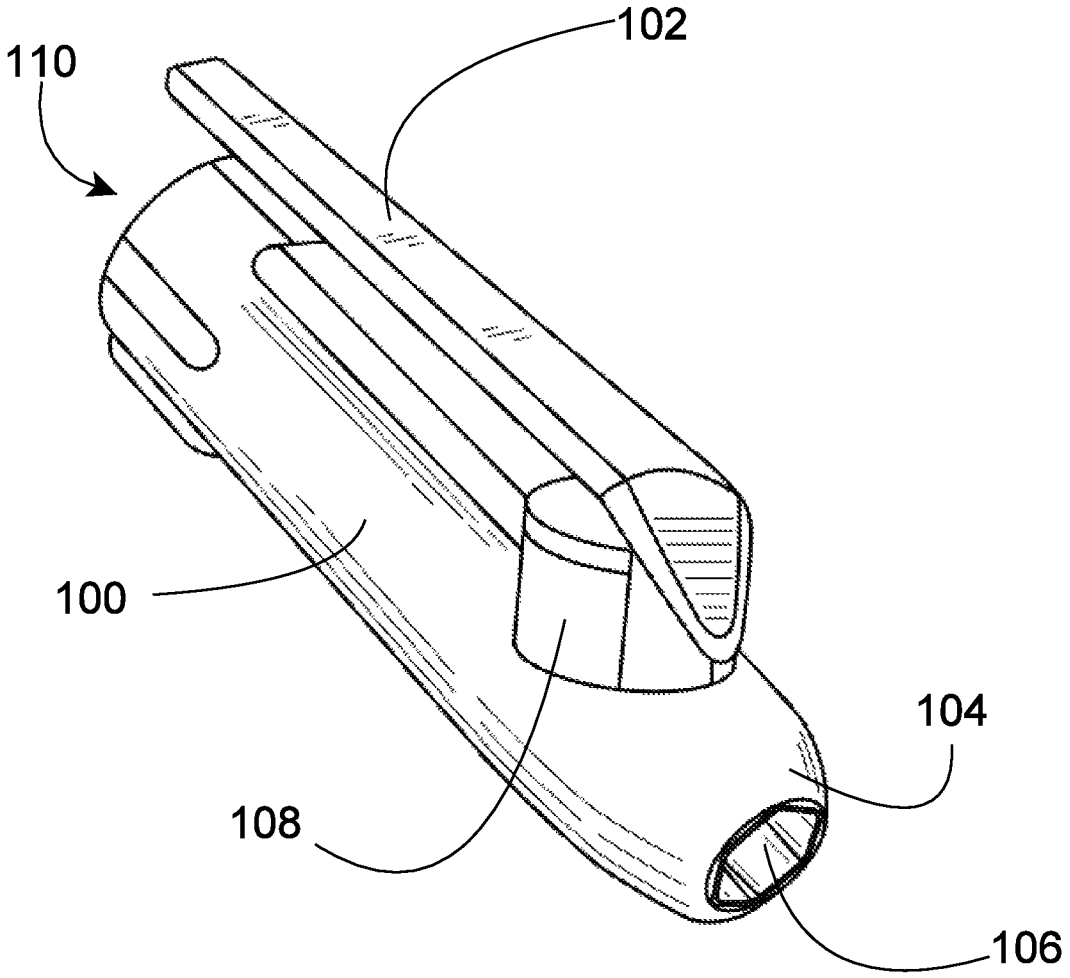
FIG. 1 is an oblique elevational orthogonal diagram of a first embodiment of the invention showing the hex drive without a bit installed.
Figure 2:
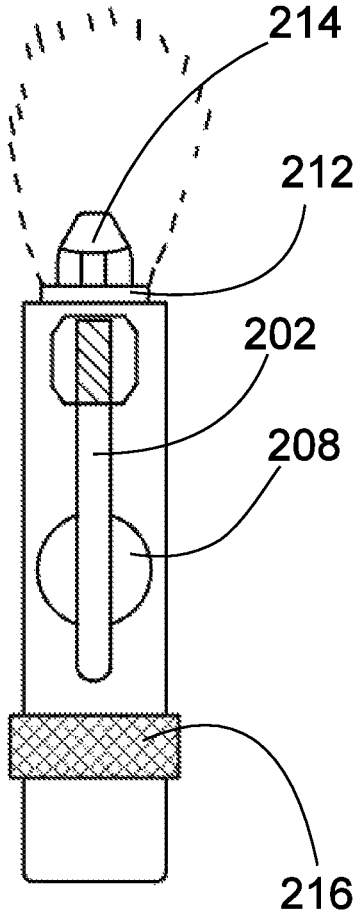
FIG. 2 is a side view of a second embodiment of the invention showing a loom of light from a drive socket projecting around and past a bit.
Figure 3:
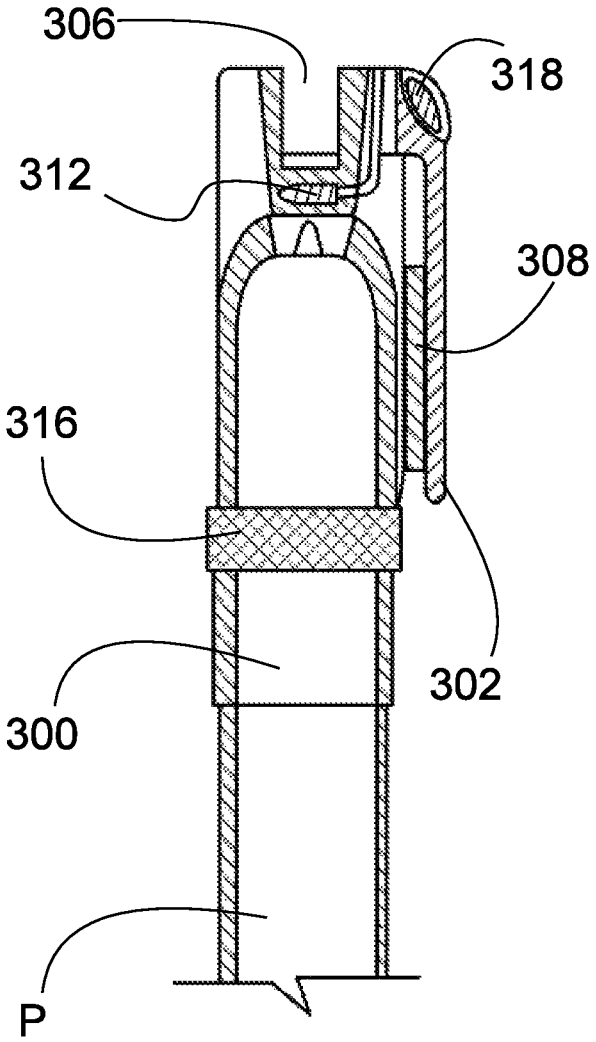
FIG. 3 is a cross-sectional side view of a third embodiment of the invention, similar to the second embodiment, without the bit installed in the drive socket.
Figure 5:
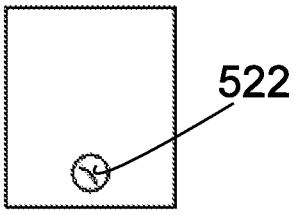
FIG. 5 is a different side view of another alternative embodiment socket showing the hole through which an LED might be inserted during manufacture.
Figure 6:
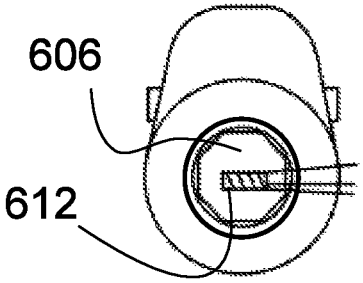
FIG. 6 is an end view in partial transparency showing an alternative socket end on with the LED visible at the bottom.

| | |
|---|---|
| FIG. 1 | |
| Body | 100 |
| Clip | 102 |
| End | 104 |
| Hex drive socket | 106 |
| Battery cover | 108 |
| Pen tip cavity | 110 |
| FIG. 2 | |
| Clip | 202 |
| Battery cover | 208 |
| LED/socket | 212 |
| Hex drive (Hexbit) | 214 |
| Knurled grip | 216 |
| FIG. 3 | |
| Marker/pen | P |
| Body | 300 |
| Clip | 302 |
| Hex drive socket | 306 |
| Battery cover | 308 |
| LED | 312 |
| Knurled grip | 316 |
| Switch | 318 |
| FIG. 5 | |
| Hole for LED | 522 |
| FIG. 6 | |

-continued

Figure 7:
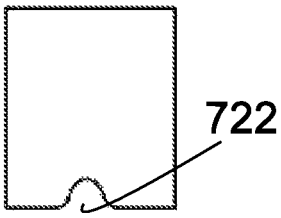
FIG. 7 is a side view of yet another alternative embodiment socket showing a groove or channel through which an LED might be inserted during manufacture, in contrast to FIG. 5 or FIG. 4.
Figure 8:
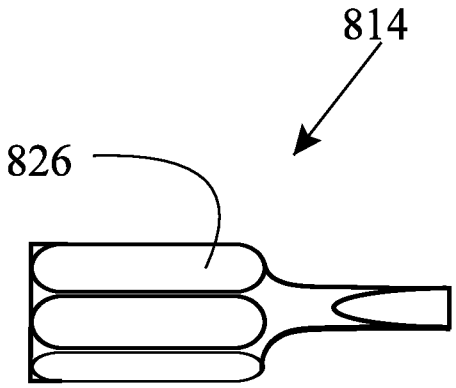
FIG. 8 is a side view of a hex bit tool head, showing a fine tip screwdriver head on a multi-sided base.
Figure 9:
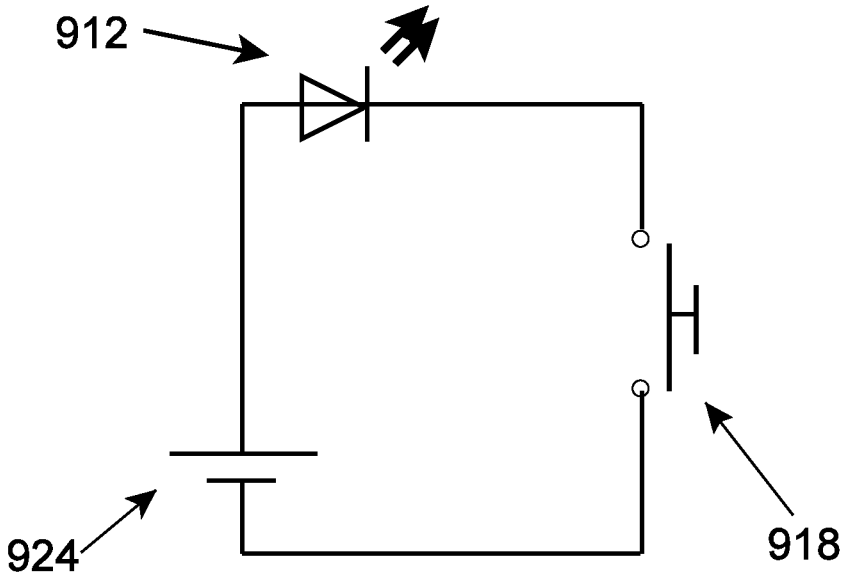
FIG. 9 is a simple wiring diagram showing how the device may be implemented so as to provide low light assistance.
Figure 10:
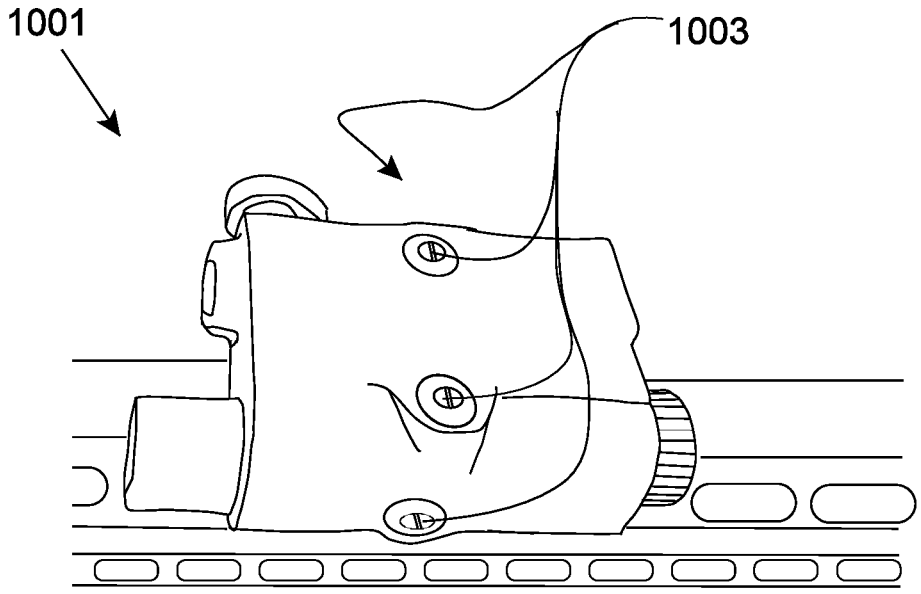
Fig. 10 PRIOR ART
FIG. 10 is a PRIOR ART drawing of a laser aiming device atop a gun.
Figure 11:
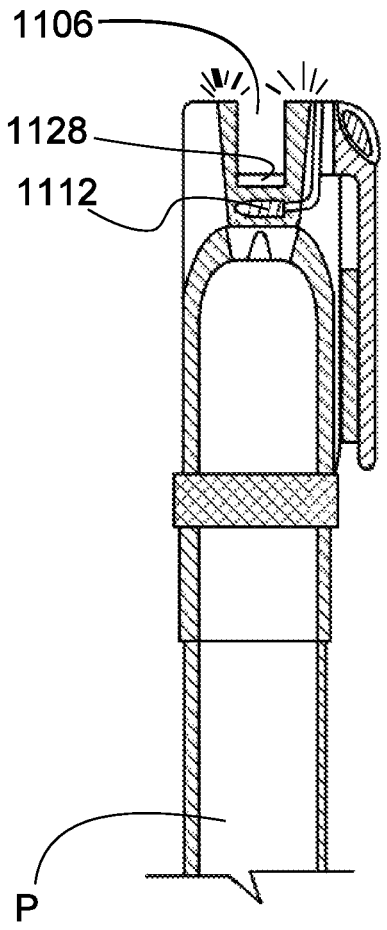
FIG. 11 is a cross-sectional side view of another embodiment of the invention, similar to the second embodiment, with a magnet in the end of the transparent/translucent material of the drive socket.

| INDEX TO REFERENCE NUMERALS | |
|---|---|
| Hex drive socket | 606 |
| LED | 612 |
| FIG. 7 | |
| Channel for LED | 722 |
| FIG. 8 | |
| Hex drive | 814 |
| Hex base for socket | 826 |
| FIG. 9 | |
| LED | 912 |
| Switch | 918 |
| Battery | 924 |
| FIG. 10 (PRIOR ART laser/IR aiming device) | |
| Laser aiming device | 1001 |
| Elevation/windage screws | 1003 |
| FIG. 11 | |
| Pen | P |
| Hex drive socket | 1106 |
| Light source | 1112 |
| Magnet | 1128 |

DETAILED DESCRIPTION

Glossary

For purposes of the present application, the word "dim" is defined to mean having a light output of less than 5 lumens.

Infrared refers to frequencies of light not normally visible without special equipment.

Hex drive refers to a socket having a hexagonal, square, pentagonal, octagonal shape into which small bits or tool heads, specifically including small screwdrivers, may be inserted.

End Glossary

FIG. 1 is an oblique elevational orthogonal diagram of a first embodiment of the invention showing the hex drive without a bit installed. Body 100 is in the shape of a marker cap, having a generally cylindrical configuration with a closed end 104.

Clip 102 on the side may be slightly resilient and may urge itself against the exterior of body 100, so that the device may be clipped onto fabric such as a belt, a pocket, webbing, straps and so forth, or may be clipped onto other thin objects (clip boards for example).

Closed end 104 has a small space therein: hex drive socket 106. The hex drive socket 106 does not penetrate into the pen tip cavity 110. The pen tip cavity 110 (at a second, obviously open end) is dimensioned and configured to accept a particular diameter of marker. This can be keyed to a particular brand or otherwise selected and known. When the marker end is inserted into pen tip cavity 110, the inside of cavity 110 and the outside surface of the marker engage frictionally and the cap is secured. Pen tip cavity 110 is completely air tight, so when it is placed over the writing tip of the marker, the marker does not dry out.

Battery cover 108 covers a standard size of coin battery/watch battery.

FIG. 2 is a side view of a second embodiment of the invention showing a loom of light from a drive socket projecting around and past a hex bit in the socket.

Clip 202 is now seen from a different angle. In this embodiment, battery cover 208 is located in a slightly different location as well.

LED/socket 212 is seen only as part of the socket, that is, the light shines around the hex bit 214 via the transparent socket material and illuminates the area in front of the hex bit 214.

Hex bit 214 is seen projecting from the socket, filling it in this embodiment. The hex bit 214 is surrounded by a modest loom of light from the indirect source of illumination.

It will be noticed that the removal of the hex bit 214 may in embodiments immediately increase the amount of light provided by the LED.

Knurled grip 216 provides a more secure grip in a user's fingers.

The device can be used while on the marker, or removed from the marker first, as the user finds best.

To use the device, the operator may remove it from the marker (as the body of the marker may have only a frictional engagement to the interior pen tip cavity and/or the body of the marker may interfere with a secure fingertip grip on the knurled grip 216). The user may also allow the device to remain on the marker, however, the marker is not torqueable due to the frictional engagement between cap and marker. Torque is not required to any great degree: the makers of the laser aiming devices engineer the devices to require micro-clicks only during the adjustment process.

FIG. 3 is a cross-sectional side view of a third embodiment of the invention, similar to the second embodiment, without the bit installed in the drive socket but with marker/pen P shown disposed inside of the pen tip cavity.

Body 300 has another angle shown, with clip 302 seen edge on.

Hex drive socket 306 is seen in profile and cross section with the LED 312 at the bottom under the hex drive socket 306.

Hex drive socket 306 may advantageously be a material which is translucent or transparent: this will be discussed further in regard to FIG. 11.

Battery cover 308 is also seen edge on: in this embodiment the battery cover 308 may be part of the clip 302.

LED 312, as noted previously, may be a dim LED, a red LED, infrared and so on.

Switch 318 may control operation of the LED 312. Switch 318 may have a first on position and a second off position (in the first position electricity may flow and activate the LED 312, in the second position there is no circuit formed). In addition, LED 312 and switch 318 may be of complex construction and type with multiple options for operation: different colors, timed illumination, blinking patterns, and especially different intensities of light.

Knurled grip 316 is also seen.

Figure 4:
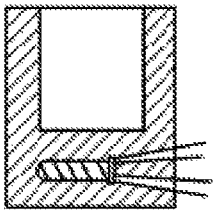
FIG. 4 is a cross-sectional side view of an alternative embodiment socket showing an embedded LED and wiring.

FIG. 4 is a cross-sectional side view of an alternative embodiment socket showing an embedded LED and wiring. It may be seen that the socket has been formed around the LED, which is permanently encased in the socket material, which may in some embodiments be transparent.

FIG. 5 is a different side view of another alternative embodiment socket showing the hole through which an LED might be inserted during manufacture.

Hole for LED 522 allows the LED to be placed without having the socket formed around it.

FIG. 6 is an end view in partial transparency showing an alternative socket end on with the LED visible at the bottom.

Hex drive socket 606 has LED 612 visible through the transparent material of the socket.

FIG. 7 is a side view of yet another alternative embodiment socket showing a groove or channel through which an LED might be inserted during manufacture, in contrast to FIG. 5 or FIG. 4.

Channel for LED 722 allows the LED to be in place and then the socket to be inserted atop it, further aiding manufacture.

FIG. 8 is a side view of a hex bit tool head, showing a fine tip screwdriver head on a multi-sided base.

Hex drive 814 has a hex base for socket 826. Equivalently, the base may be octagonal, square, and so forth.

Numerous types of bits may be used as well, for other purposes, though carrying a large number into the field is not as easy as carrying a single bit in the hex cap itself.

FIG. 9 is a simple wiring diagram showing how the device may be implemented so as to provide low light assistance. LED 912 is electrically connected on one side to switch 918, which in turn has an electrical connection to battery 924. Battery 924 is then connected to the other side of LED 912, completing a circuit. While the operative electrical connection may be direct from component to component, it is anticipated that it may also be wires. Note that the components shown are not exclusive: the device may have multiple coin batteries instead of one, multiple LEDs, complex control switches, electrical components of entirely different functions and so forth.

FIG. 11 is a cross-sectional side view of another embodiment of the invention, similar to the second embodiment, with a magnet 1128 in the end of the transparent/translucent material of the drive socket 1106.

Pen P may be seen but is not necessary to understanding this embodiment. In this case the hex drive socket 1106 may be seen to be a translucent material, or even a transparent material (this will depend upon the characteristics of the LED illumination, the desired level of brightness of the embodiment, etc.). In fact, in the previous embodiment shown in FIG. 3 the material may be translucent/transparent.

Light source 1112 thus shines upward even though a hex bit (not shown here) is in the socket, blocking the light. Magnet 1128 also blocks the light. However, the light source 1112 nonetheless creates a loom of light at the end because it may shine around the magnet and bit, the light beams traveling through the material itself.

Testing has revealed that the device may actually be printed in harder polymers and successfully function. In addition to the manufacturing advantage this provides, it may also remove the need for transporting the device to remote areas if a data connection and 3D printer are locally available. The device may also be fashioned of molded plastic, and can further be machined or formed from metal.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A device for use on a standard diameter marker, the device comprising: a cap body having a pen tip cavity at a second end thereof dimensioned and configured to frictionally engage to the standard diameter marker, the pen tip cavity being airtight when engaged to the standard diameter marker whereby the standard diameter marker does not dry; the cap body having a first end having thereon a hex drive socket; the cap body having an LED disposed at the hex drive socket; the cap body having a battery therein; the cap body having a switch, the switch having an on position and an off position; the battery, the LED and the switch being in electrical communication with one another whereby when the switch is in the on position the LED provides illumination emitting out of the hex drive socket; a magnet disposed within the hex drive socket to magnetically engage a hex bit for fine adjustment of tactical laser aiming devices.

2. The device of claim 1, further comprising:

a knurled grip section on the cap body.

3. The device of claim 2, wherein the hex bit for fine adjustment of tactical laser aiming devices comprising: a hex bit dimensioned and configured to fit within the hex drive socket; whereby when the hex bit is within the hex drive socket it is magnetically engaged thereto.

4. The device of claim 3, further comprising:

a flexible clip attached to the exterior of the cap body, the flexible clip urging itself against the exterior of the cap body.

5. The device of claim 4, further comprising:

a battery cover disposed over the battery, the battery and batter cover disposed between the clip and the cap body.

6. The device of claim 5, wherein the hex drive socket comprises a transparent material;

whereby the LED disposed in the hex drive socket may shine through the transparent material and shine past the hex bit.

7. The device of claim 6, wherein:

the LED is disposed at the hex drive socket and within it.

8. The device of claim 1, wherein the LED further comprises:

a red LED.

9. The device of claim 1, wherein the LED further comprises:

an LED with a light output of less than 5 lumens;

whereby it is more difficult to observe use of the LED and use of the LED will not reduce night vision.

* * * * *